US006302224B1

(12) United States Patent
Sherwood, Jr.

(10) Patent No.: US 6,302,224 B1
(45) Date of Patent: Oct. 16, 2001

(54) DRAG-BIT DRILLING WITH MULTI-AXIAL TOOTH INSERTS

(75) Inventor: William H. Sherwood, Jr., Spring, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 09/311,155

(22) Filed: May 13, 1999

(51) Int. Cl.[7] ..... E21B 10/42
(52) U.S. Cl. ..... 175/397; 175/413; 175/432
(58) Field of Search ..... 175/327, 397, 175/413, 420.1, 420.2, 425, 426, 428, 431, 432

(56) References Cited

U.S. PATENT DOCUMENTS

| | | | |
|---|---|---|---|
| 4,140,189 | | 2/1979 | Garner . |
| 4,200,159 | * | 4/1980 | Peschel et al. . |
| 4,334,585 | * | 6/1982 | Upton . |
| 4,529,048 | * | 7/1985 | Hall . |
| 4,533,004 | | 8/1985 | Ecer . |
| 4,538,691 | | 9/1985 | Dennis . |
| 4,570,726 | | 2/1986 | Hall . |
| 4,593,777 | | 6/1986 | Barr . |
| 4,640,374 | | 2/1987 | Dennis . |
| 4,640,375 | | 2/1987 | Barr et al. . |
| 4,679,639 | | 7/1987 | Barr et al. . |
| 4,711,144 | * | 12/1987 | Barr et al. . |
| 4,714,120 | | 12/1987 | King . |
| 4,749,052 | * | 6/1988 | Dennis . |
| 4,784,023 | | 11/1988 | Dennis . |
| 4,858,707 | | 8/1989 | Jones et al. . |
| 4,862,977 | * | 9/1989 | Barr et al. . |
| 4,877,096 | * | 10/1989 | Tibbitts . |
| 4,972,912 | | 11/1990 | Keshavan . |
| 4,993,505 | | 2/1991 | Packer et al. . |
| 5,111,895 | | 5/1992 | Griffin . |
| 5,244,039 | | 9/1993 | Newton, Jr. et al. . |
| 5,285,859 | | 2/1994 | Tibbitts . |
| 5,301,762 | | 4/1994 | Besson . |
| 5,316,095 | | 5/1994 | Tibbitts . |
| 5,333,699 | | 8/1994 | Thigpen et al. . |
| 5,348,109 | | 9/1994 | Griffin . |
| 5,425,288 | | 6/1995 | Evans . |
| 5,447,208 | | 9/1995 | Lund et al. . |
| 5,449,048 | | 9/1995 | Thigpen et al. . |
| 5,505,273 | | 4/1996 | Azar et al. . |
| 5,531,281 | | 7/1996 | Murdock . |
| 5,558,170 | | 9/1996 | Thigpen et al. . |
| 5,653,300 | | 8/1997 | Lund et al. . |
| 5,706,906 | | 1/1998 | Jurewicz et al. . |
| 5,947,216 | * | 9/1999 | Truax et al. . |

* cited by examiner

*Primary Examiner*—Roger Schoeppel
(74) *Attorney, Agent, or Firm*—Groover & Associates; Robert Groover

(57) ABSTRACT

Angled insertable drag bit teeth having a front portion at an oblique angle to a shank portion: the front portion is nearly parallel to the direction of thrust during cutting, and is bonded, along a substantial part of its length, to a groove in the bit body. The shank portion extends down into a pocket in the bit body. Preferably the front portion is faced with a superhard material such as polycrystalline-diamond-compact.

10 Claims, 14 Drawing Sheets

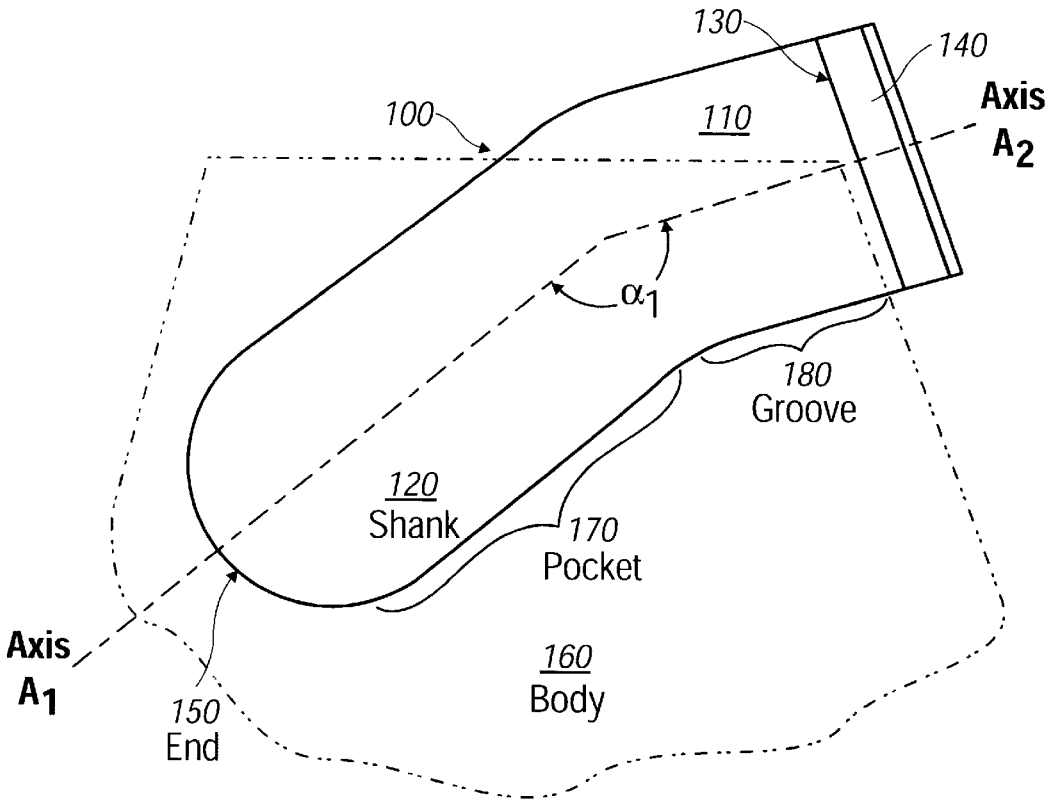
FIG. 1A
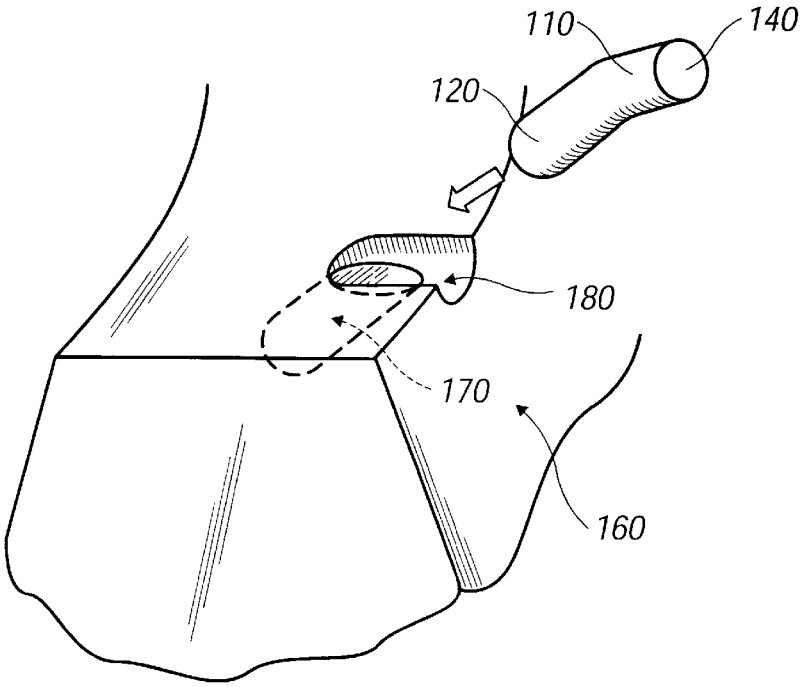
FIG. 1A1

DRAG-BIT DRILLING WITH MULTI-AXIAL TOOTH INSERTS

BACKGROUND AND SUMMARY OF THE INVENTION

The present invention relates to drag-type drill bits, methods, and systems, and more particularly to replaceable teeth used in such bits.

Background: Rotary Drilling

Oil wells and gas wells are drilled by a process of rotary drilling. In conventional vertical drilling a drill bit is mounted on the end of a drill string (drill pipe plus drill collars), which may be several miles long. At the surface a rotary drive turns the string, including the bit at the bottom of the hole, while drilling fluid (or "mud") is pumped through the string.

When the bit wears out or breaks during drilling, it must be brought up out of the hole. This requires a process called "tripping": a heavy hoist pulls the entire drill string out of the hole, in stages of (for example) about ninety feet at a time. After each stage of lifting, one "stand" of pipe is unscrewed and laid aside for reassembly (while the weight of the drill string is temporarily supported by another mechanism). Since the total weight of the drill string may be hundreds of tons, and the length of the drill string may be tens of thousands of feet, this is not a trivial job. One trip can require tens of hours, and this is a significant expense in the drilling budget. To resume drilling the entire process must be reversed. The bit's durability is very important, to minimize round trips for bit replacement during drilling.

The bit's teeth must crush or cut rock. The necessary forces are supplied by the "weight on bit" (WOB) which presses the bit down into the rock, and by the torque applied at the rotary drive. The WOB and torque are controlled to match the bit type, size, and drilling conditions, but the WOB may in some cases be 100,000 pounds or more. However, the forces actually seen at the drill bit are not constant: the rock being cut may have harder and softer portions (and may break unevenly), and the drill string itself can oscillate in many different modes. Thus the drill bit must be able to operate for long periods under high stresses in a remote environment.

Background: Drag-Type Bits

The simplest type of bit is a "drag" bit, where the entire bit rotates as a single unit. The body of the bit holds fixed teeth, which are typically made of an extremely hard material, such as e.g. tungsten carbide faced with polycrystalline diamond compact (PDC). The body of the bit may be steel, or may be a matrix of a harder material such as tungsten carbide.

As the drillstring is turned, the teeth of the drag bit are pushed through the rock by the combined forces of the weight-on-bit and the torque seen at the bit. (The torque at the bit will be somewhat less than the rotary torque, due to drag along the length of the drill string. The torque at the bit may also contain a dynamic component due to oscillation modes of the drill string). Since the weight-on-bit and the rotary torque are controlled by the driller, the net thrust vector seen at the tooth face will be slightly uncertain; but the normal range of torque and WOB values will imply only a relatively small range of angular uncertainty for each tooth's net force vector. (The rate-of-penetration and the hardness of the formation also have some effect on the orientation of the thrust vector seen at the tooth.) Thus each tooth can be aligned to an expected thrust direction, within a cone of a few degrees of uncertainty.

Background: Failure Modes of PDC-Type Teeth

The drilling environment is a harsh one, with high shock loading, high temperatures, and abrasive fluid flows. Even with modern superhard materials (such as PDC facings on a tungsten carbide body), drilling contractors often must perform expensive "trips" merely to replace drill bits.

All drill bit teeth can be expected to fail eventually. However, an important question is: How do they fail? PDC-type drill bit teeth have at least three important failure modes, as illustrated schematically in FIGS. 20A–20C. (These failure modes are illustrated for the bullet-type tooth of FIG. 20, but are relevant to many other tooth types as well.)

The most innocuous mode, illustrated in FIG. 20A, is inward abrasive wear of the cutting face. The side of the tooth's superhard face 2040 is gradually eroded inward, so that portion 2000' of the tooth's volume is gradually removed.

A less welcome failure mode, illustrated in FIG. 20B, is fracture. The force on the tooth's face is not distributed evenly, so it is possible for failure in shear to occur (where part of the face, and the part of the body behind it, breaks away from the rest of the tooth). This is a particularly damaging failure mode, since the separated tooth fragment 2000" is likely to be encountered by the next tooth behind it. The separated tooth fragment 2000", unlike the rock being drilled, is just as hard and has just as high a yield stress as the tooth behind it. Thus the separated tooth fragment 2000" has some chance of breaking the following tooth also. There is thus some chance of a "chain reaction," where trash from one broken tooth causes tooth breakage to propagate to corresponding locations all the way around the bit.

An even more unwelcome failure mode, illustrated in FIG. 20C, is "prying out" failure, where all or most of a single tooth's volume is removed from its socket. The single mass of tooth material has an even better chance of damaging the following tooth.

Background: Angled Teeth

Some attempts have been made to use angled teeth in drag bits. FIG. 18 shows a conventional drill bit tooth 1810 which contains two nonparallel axes. This design has not come into wide use. The cantilevered front portion 1820 of the tooth provides a weak spot where large fragments or stray trash can exert outward forces; such outward forces can cause the inside of the bend to begin to fail in tension, and cracks can then propagate quickly. Even without trash or cuttings wedging under the front portion of the tooth, transient impacts at the face of the tooth can also translate to a net outward torque at the bend of the tooth, and this can lead to rapid failure. Thus such teeth are susceptible to failure modes which include being levered up, or failing in tension at the inner radius of the angle, or failing in shear across the shank.

FIG. 19 shows a different conventional drill bit tooth which has less of its length protruding from the body. This bit contains a face 1920 bent at an angle of roughly 90 degrees to the shank 1910 of the tooth. Here the very sharp angle between the cutting face and the shank produces a point of stress concentration, which is conducive to possible failure. Moreover, the thickness of material through which a shear-failure crack or defect must propagate through is at most the thickness of the tooth's shank 1910. Such teeth are often backed by a portion of the steel bit body, but still the failure resistance is less than optimal. When the tooth starts to fail, its resultant cutting radius changes rapidly.

Background: "Bullet"-Type Teeth

FIG. 20 shows a sectional view of bullet-type drill bit tooth 2000 as disclosed in a sample embodiment of commonly-owned U.S. Pat. No. 5,558,170 to Thigpen et al. This patent, which is hereby incorporated by reference, describes (among other teachings) a drag-type drill bit in which the teeth are cylindrical, with a hemispherical back end 2050 for seating into a milled pocket. Typically the body 2010 of the tooth is a hard strong material, such as cemented tungsten carbide, and its front end is typically a flat circle which is coated with a superhard material 2040 such as a polycrystalline diamond compact ("PDC"). By using a spherical mill, an open cylindrical pocket with a spherically-shaped end surface can be machined into a steel bit body 2060 to provide a reasonably close fit to such a tooth, and the tooth can be brazed into the pocket to form a high-strength joint. By designing the pocket so that its sidewalls extend up to partially enclose the top of the tooth 2000, some resistance against prying-out of the tooth is obtained.

This configuration provided an improvement over some of the shortcomings of conventional PDC-type bits and teeth. The tooth's main axis is nearly parallel to the main force vector seen during cutting, so that shear failure is well opposed. Moreover, the stiffness of cemented carbide materials is higher than that of steel, so the rigidity of this mounting helps to suppress chatter and analogous instabilities. A further advantage of this configuration is that the body of the tooth, behind the superhard face, provides an additional hard sliding surface area for rock contact when abrasive wear begins to reduce the area of the tooth face.

Drag-Bit Drilling with Multi-Axial Tooth Inserts

The present application discloses drill bits, teeth, and manufacturing and replacement methods for drag-type drill bits with inserted teeth. The innovative teeth are bent: each includes a front portion which is bonded to the body of the bit along a substantial part of its length, and a shank portion which is not parallel to the front portion. (Preferably the front portion is supported along a length which is greater than half the maximum diameter of the shank.) The shank portion provides more secure attachment than is obtained from a conventional "bullet"-type tooth.

The disclosed innovations, in various embodiments, provide one or more of at least the following advantages:

Stronger bonded assembly;

Compatibility of different tooth geometries with secure mounting to a given bit design;

More resistance to "pry-out" failure; and

Field replacement: when a tooth breaks, the pocket is usually not destroyed. Thus a repair technician can actually replace a damaged tooth on the drill rig floor. This provides additional flexibility to make field repairs, and reduces the need to stock and rapidly transport drill bits.

BRIEF DESCRIPTION OF THE DRAWING

The disclosed inventions will be described with reference to the accompanying drawings, which show important sample embodiments of the invention and which are incorporated in the specification hereof by reference, wherein:

FIG. 1A shows a sectional view of several embodiments of a drill bit tooth which contains two nonparallel axes. FIG. 1A1 shows a perspective of this tooth and socket prior to insertion into the bit.

DETAILED DESCRIPTION OF THE PREFERRED EMBODIMENTS

The numerous innovative teachings of the present application will be described with particular reference to the presently preferred embodiment (by way of example, and not of limitation).

Definitions

Following are short definitions of the usual meanings of some of the technical terms which are used in the present application. (However, those of ordinary skill will recognize whether the context requires a different meaning.) Additional definitions can be found in the standard technical dictionaries and journals.

A "drag bit" is a type of rotary drill bit which does not include any cutting teeth on rolling elements.

"Mud" refers to the drilling fluid which is pumped down through the drill string (typically at high flow rates and high pressures) during drilling.

"Superhard" refers to materials which are harder than normal cemented tungsten carbides.

Sample Embodiment

Figure 1B:
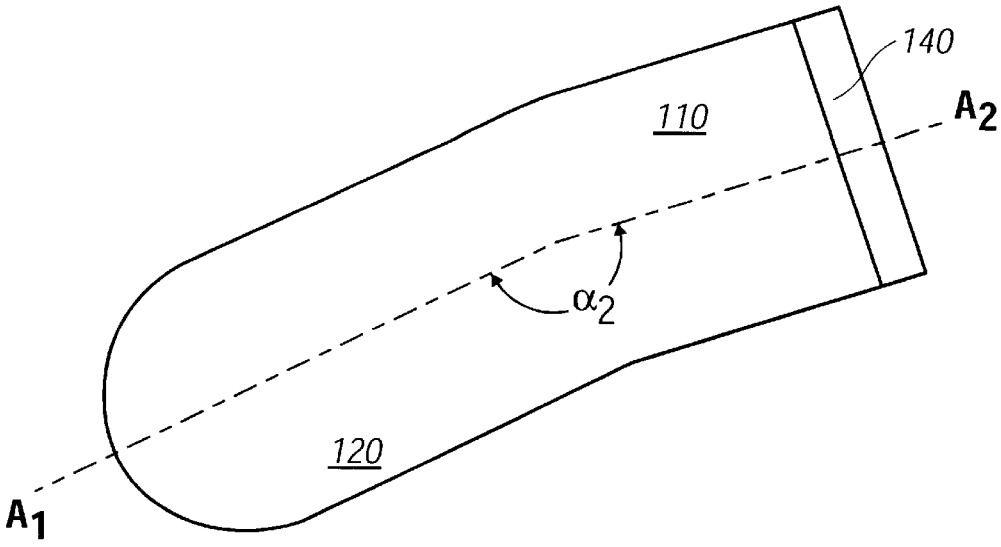
FIGS. 1B and 1C show alternative embodiments of a drill bit tooth which contains two nonparallel axes, with bend angles different from the embodiment of FIG. 1A.
Figure 1C:
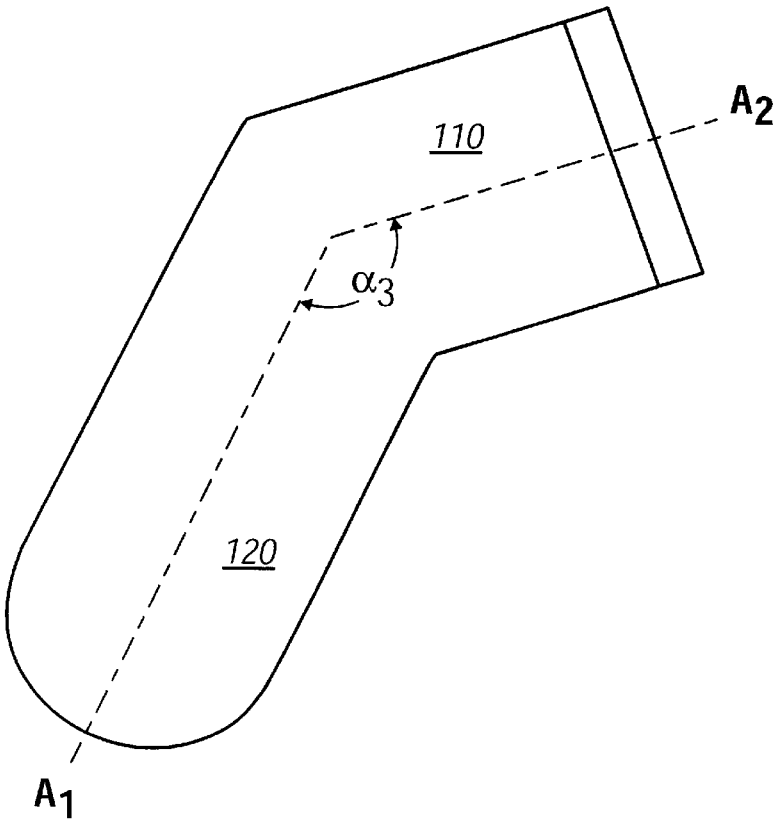

FIGS. 1A–1C show several embodiments of a drill bit tooth 100 which contains two nonparallel axes. In the sample embodiment of FIG. 1A, the shape of the tooth is defined by a front portion 110 of cylindrical cross-section, and a shank 120 which has an equal cylindrical cross-section. The front portion has a substantially planar face 130 which is coated with a superhard material 140. The shank, in this embodiment, has a hemispherical end 150. This figure also shows a portion of drill bit body 160 in which the pocket 170 and groove 180 are formed. (The portion shown is the outward end of a flange, but of course teeth can also be located elsewhere on the bit body, as discussed below.)

In the embodiment of FIG. 1A the angle $\alpha_1$ between the central axis front portion and the shank is drawn as approximately 150°. FIG. 1B shows another embodiment which is generally similar to the embodiment of FIG. 1A, except that the angle $\alpha_2$ between axes $A_1$ and $A_2$ is approximately 165°. FIG. 1C shows yet another embodiment which is generally similar to the embodiment of FIG. 1A, except that the angle $\alpha_3$ between axes A1 and A2 is approximately 135° in this example.

It is preferred that the angle ai between the front portion and the shank should be in the range between about 135° and about 170° inclusive. However, in some less preferred disclosed embodiments angles outside this range are presented as alternatives. Angles of less than 170° are particularly advantageous, as compared to the bullet-type tooth of FIG. 20, since a longer tooth shank can be used for a given thickness of the bit's rib. Angles of about 135° or more are particularly advantageous, as compared to the tooth of FIG. 19, due to the capability for field repair and the improved resistance to fracture in shear.

Figure 18:
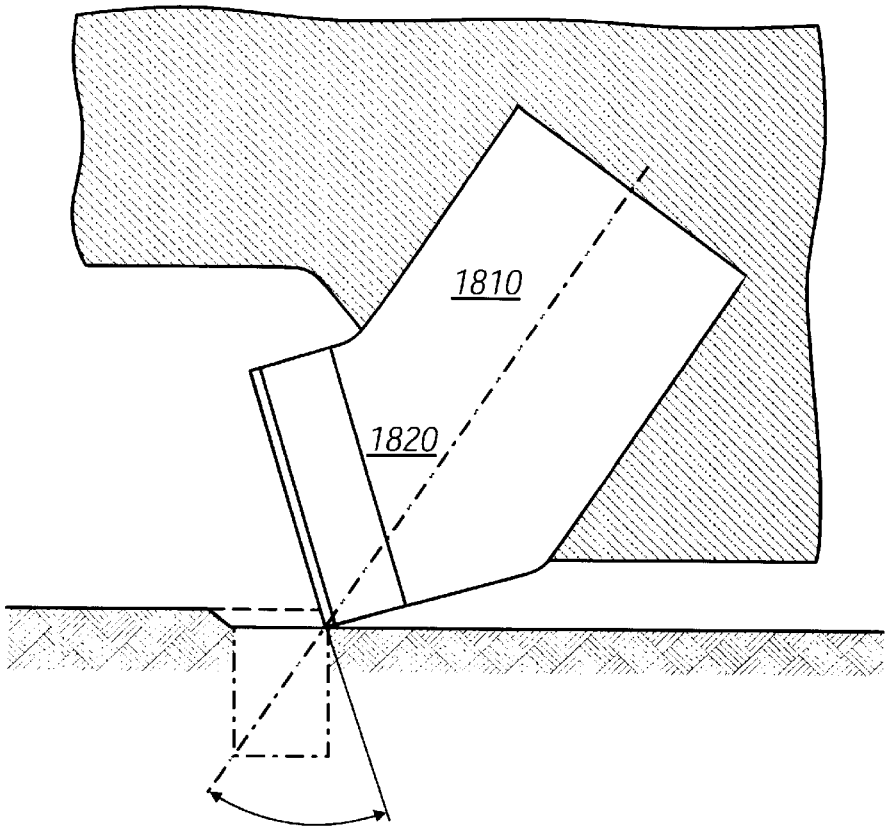
FIG. 18 ( PRIOR ART )
FIG. 18 shows a conventional drill bit tooth which contains two nonparallel axes.
Figure 19:
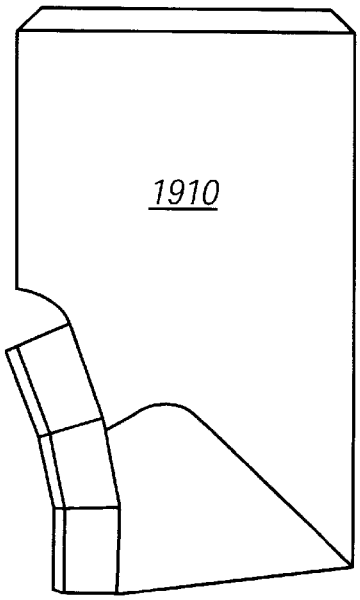
FIG. 19 ( PRIOR ART )
FIG. 19 shows a conventional drill bit tooth which contains a face bent at an angle to the shank of the tooth.
Figure 20A:
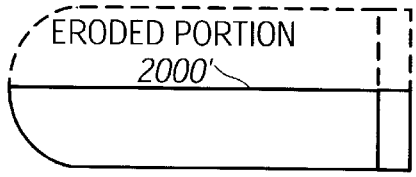
FIG. 20A ( PRIOR ART )
FIGS. 20A, 20B, and 20C show three possible failure modes of PDC-type teeth.
Figure 20:
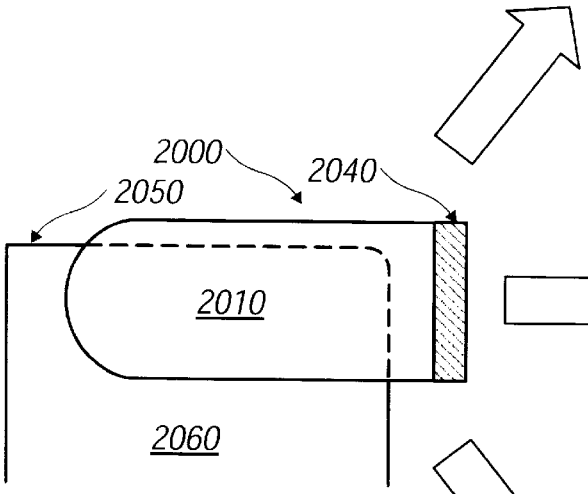
FIG. 20 ( PRIOR ART )
FIG. 20 shows a bullet-type drill bit tooth as disclosed in a sample embodiment of U.S. Pat. No. 5,558,170 to Thigpen et al.
Figure 20B:
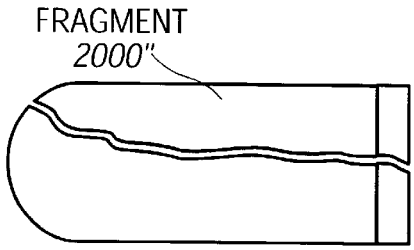
FIG. 20B ( PRIOR ART )
Figure 20C:
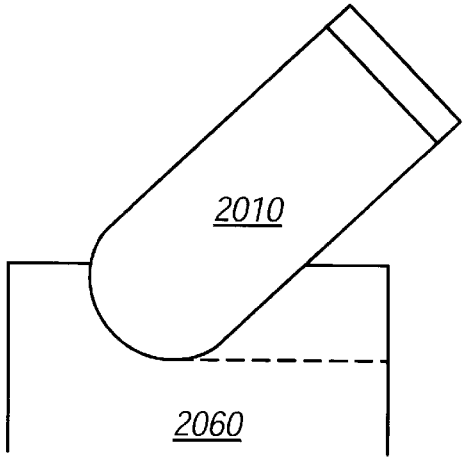
FIG. 20C ( PRIOR ART )

It is also possible for a single drill bit to contain not only teeth like those of FIGS. 1A, 1B, and/or 1C, but also conventional teeth like those of FIGS. 18, 19, and/or 20.

FIG. 1A also shows the geometry of the pocket 170 and groove 180 in a drill bit body which mates with the sample tooth embodiment of FIG. 1A. The pocket 170 is complementary to the tooth's shank 120 and end portion 150, and the groove 180 is complementary to the front portion 110. The tooth is affixed to the pocket 170 and groove 180 by a suitably strong brazing material, such as silver solder. The clearances designed into the pocket 170 and groove 180 can be, for example, a thousandth of an inch, but are dependent on the brazing technology used. However, for easy field replacement it is preferable that an interference fit not be used between shank and pocket.

In a contemplated alternative embodiment, the different thermal coefficients of expansion of steel and carbide are used to retain the tooth without brazing. To insert and remove teeth, the whole steel body of the bit is heated until differential expansion relieves the stress on the tooth.

Figure 12:
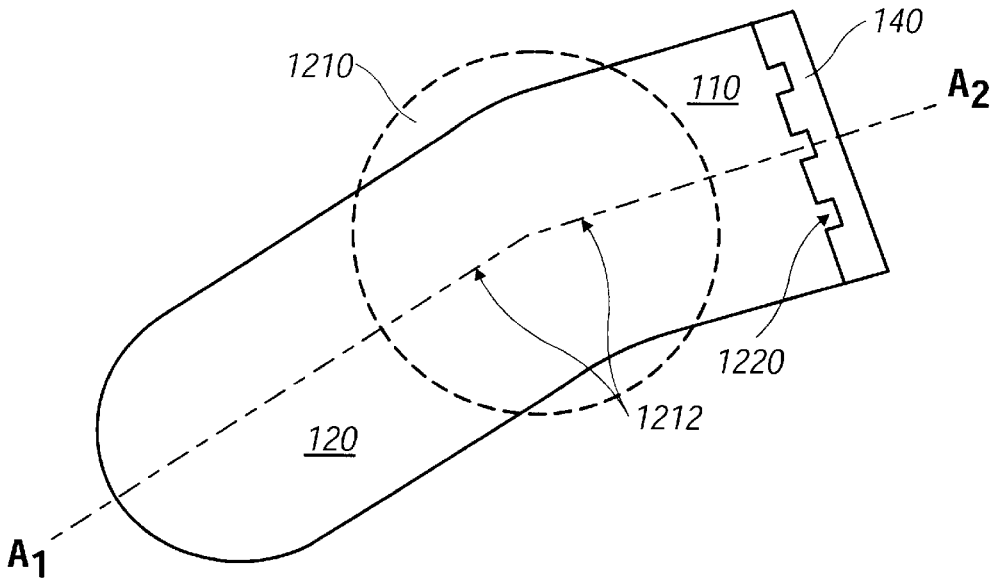
FIG. 12 shows a drill bit tooth which has a radiused bend between the shank and the front portion.

In this sample embodiment the superhard material 140 is a "PDC" material, i.e. a compact made of polycrystalline diamond in a binder matrix. In this sample embodiment the front portion 110 and shank 120 are formed from a single homogeneous body of cemented tungsten carbide. Preferably, as shown in FIG. 12, some corrugation 1220 is present at the interface between the superhard material 140 and the front portion 110. Suitable custom fabrication can be ordered from RTW Engineered Products, 205 N. 13th Street, Rogers, Ark. 72756, or from other vendors of cemented carbide products.

In the preferred embodiment the tooth is fabricated by powder-metallurgical methods. Tungsten carbide powder and a matrix material (e.g. cobalt) are pressed to the desired shape. After this initial pressing any desired grinding or polishing steps are done, and then the tooth is sintered under isostatic pressure to produce a hard and stable solid structure. After sintering (which normally causes a very significant shrinkage), grinding and/or electrodischarge machining and/or electropolishing is performed to bring the tooth to final shape. A commercially available PDC compact is then bonded to the tooth body by conventional methods.

Complete Bit

Figure 16:
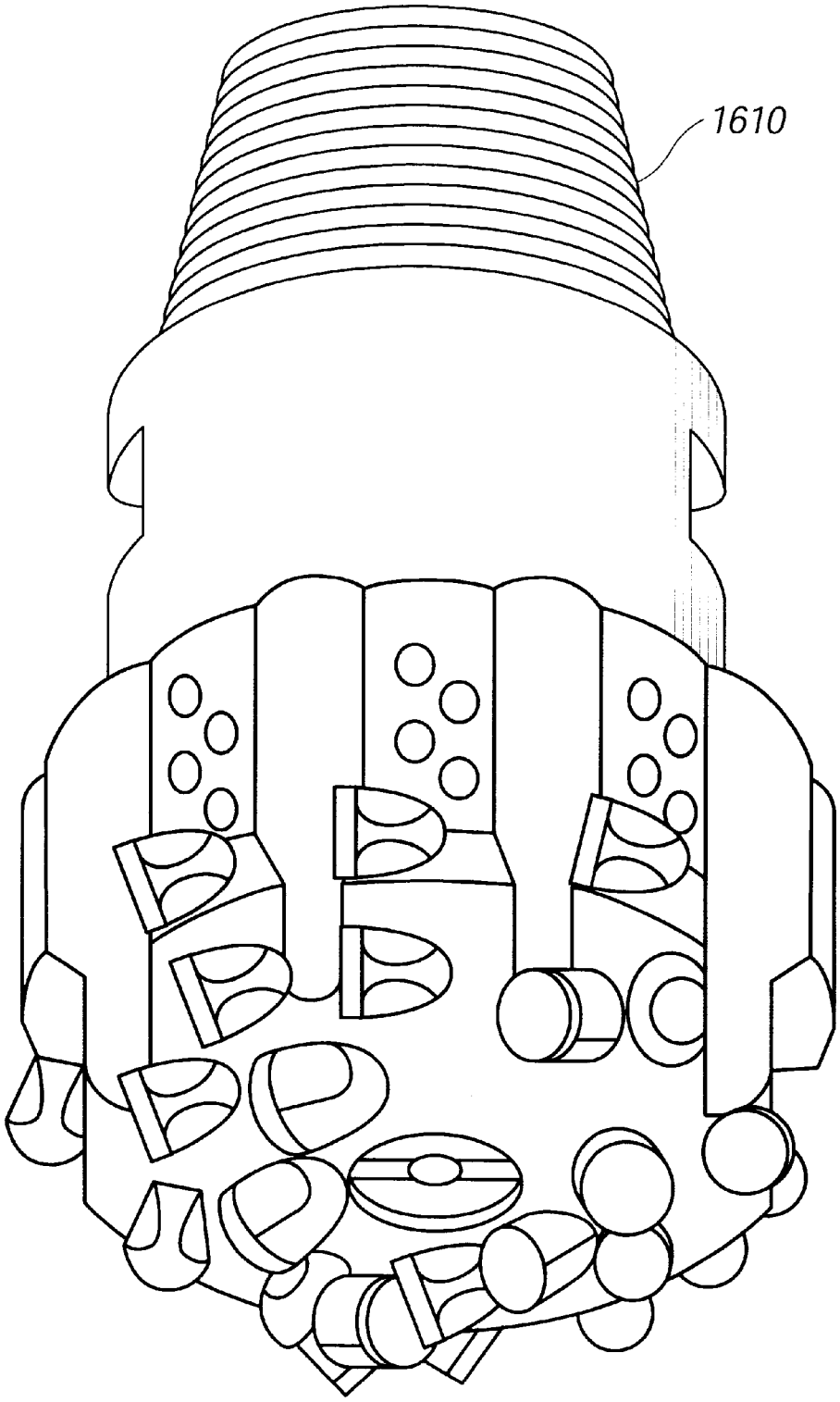
FIG. 16 shows an example of a rotary drill bit which advantageously uses angled teeth as disclosed herein.

FIG. 16 shows an example of a complete rotary drill bit which advantageously uses angled teeth as disclosed herein. Male tapered threads 1610 provide for attachment of the bit to the drill string. (For example, the bit may be screwed onto a bit sub which is screwed onto the lowest section of drill collar, or alternatively other tools or instrumentation modules can be used above the bit.) The bit normally also includes jets (not shown) which provide powerful turbulent flow to remove cuttings, and carbide buttons (not shown) which help to preserve the gage of the hole.

Field Replacement

An important advantage of various disclosed embodiments is the capability for field replacement of a tooth in a used drill bit. Preferably the remaining portions of the tooth (if any), together with the bit body near the pocket 170 and groove 180 which make contact to the tooth to be replaced, are heated until the braze material liquifies. The tooth can then be allowed to fall out (with the pocket pointing downward), or can be pulled out with pliers. (In an alternative embodiment, a drift hole can be drilled behind the pocket 170, so that a drift can be used to drive the tooth from its pocket.)

Dynamics of Drilling

As the bit rotates, each tooth cuts a kerf through the formation. (To give some idea of the dimensions here, a one-inch tooth might, for example, cut a round-bottomed groove about one-eighth of an inch deep and one quarter of an inch wide.) However, the size of this groove will depend on the bit's overall rate of penetration, the size of the tooth, its distance from the axis of the bit, and how much rock has been removed by the teeth ahead of it at the same position on the bit's cutting surface.

At each tooth, the rate of penetration, in combination with the number of teeth and the position of that tooth on the bit body, will determine the average kerf depth cut by that tooth. The average kerf depth, in combination with the rotational speed of the bit, the spacing of that tooth from the bit axis, and the (varying) hardness of the formation, will determine the average reaction force vector seen by that tooth.

Each tooth will also see a preload force vector component which is dependent on the weight-on-bit and on the angle of the cut formation surface (with respect to the wellbore axis) at that tooth's circle of rotation.

Each tooth will also see a tooth-friction force vector component which is dependent on the preload force vector component and on the area of the tooth which makes sliding contact with the formation.

These force vectors correspond to pressures which are not evenly distributed across the face of the tooth. That is, the cutting reaction force will appear almost entirely on the limited fraction of the tooth's face area which is pushing through the formation, and the weight-on-bit component will appear largely on portions of the tooth surface which are in contact with solid rock. This uneven distribution of pressures gives rise to dynamic shear stress within the tooth, which may be relevant to modelling tooth failure modes; however, for simpler estimation of the direction of the net total force at each tooth/bit interface, this uneven distribution of pressures will be ignored for now.

Another component of the total torque, which becomes particularly important as the bit wears, is an additional frictional torque component. This is contributed by the other parts of the bit which contact the rock, and by crushing of rock fragments which have been dislodged at the cutting face. This frictional torque component increases as the bit wears. Thus the reaction force vector is not necessarily zero when the rate of penetration is zero. However, this additional frictional torque component does not significantly affect the force seen at each tooth, and can be ignored in calculating tooth thrust direction.

The vector sum of the preload force vector, the reaction force, and the tooth friction vector will be the net force vector at each tooth. Since all of these force vector components are dependent on control inputs, they are not exactly known in advance. However, since each bit is designed for a certain range of WOB and rotary speed, the total force vector at each tooth can be generally predicted by engineers who are experienced in bit design. Of course, the expected total force vector defines the expected direction of force seen by the tooth. In some embodiments (as described below), that expected direction of force is used to define the orientation of the tooth's front portion.

Alternative Embodiments

Following are some of the alternative embodiments. It should be noted that these embodiments provide various modifications and adaptations, and do not all have the same advantages. Moreover, each of these embodiments can be firther modified in many ways.

Alternative Embodiment with Added Locating Structure

In this alternative embodiment additional locating structure is used to define the orientation of the mounted tooth. This simplifies manufacturing, as well as field replacement, since the fit of the front axis of the tooth to the bit body can thereby be less critical. Moreover, even if a broken tooth has damaged the bit body so that the groove does not provide precise location of the tooth axis, the additional locating structure can still provide some degree of rotational location of the front portion of the tooth.

Figure 5:
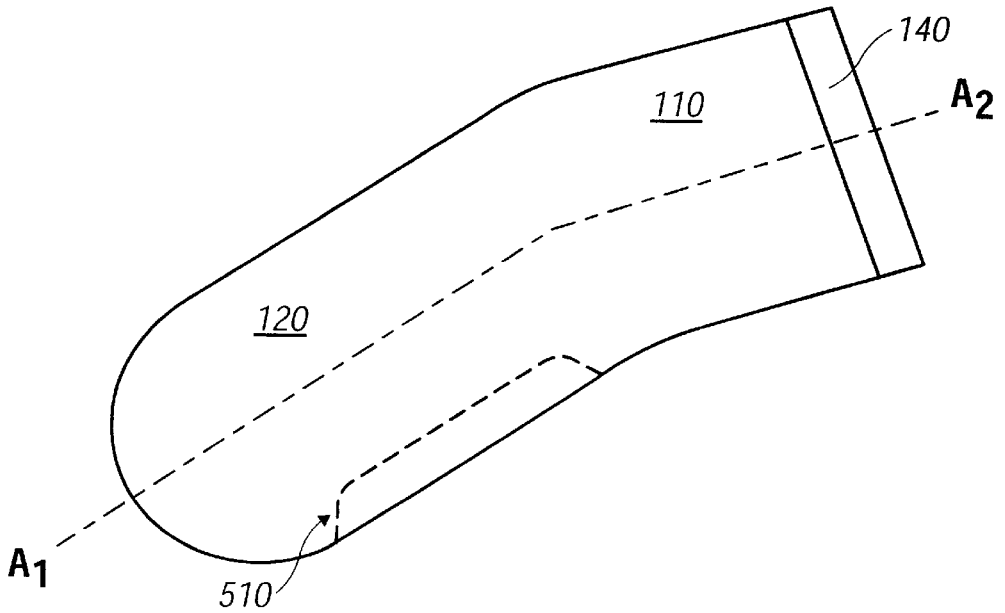
FIG. 5 shows, in an alternative embodiment, a drill bit tooth which contains two nonparallel axes, and also has a groove which mates to a rib in the pocket to provide additional control over orientation during field replacement.

FIG. 5 shows, in an alternative embodiment, a drill bit tooth which contains two nonparallel axes, and also has a groove 510 which mates to a rib in the pocket to provide additional control over orientation during field replacement.

Alternative Embodiment with Unequal Diameters along Front and Rear Axes

Figure 4:
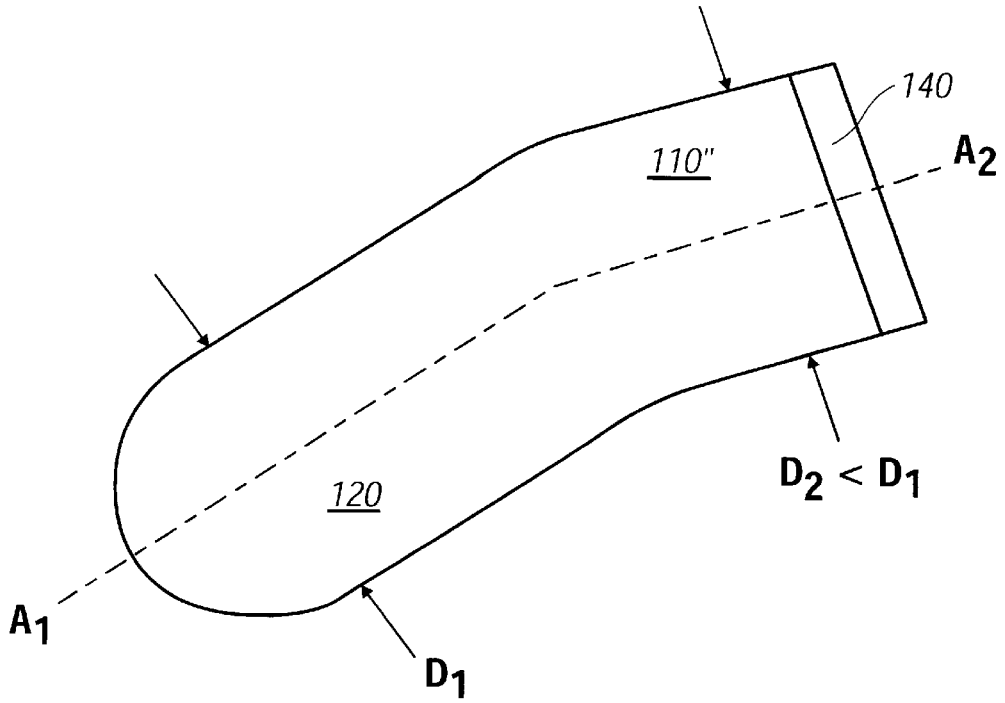
FIG. 4 shows, in an alternative embodiment, a drill bit tooth which contains two nonparallel axes, and has a smaller diameter in the front portion than in the rear portion.

In another class of alternative embodiments, it is contemplated that the tooth can have unequal diameters along its front and rear axes. FIG. 4 shows one embodiment of this class, in which a drill bit tooth contains two nonparallel axes $A_1$ and $A_2$, and has a smaller diameter $D_2$ in its front portion 110" than the diameter $D_1$ of its shank 120.

Alternative Embodiment with Non-Cylindrical Front Portion

Figure 2:
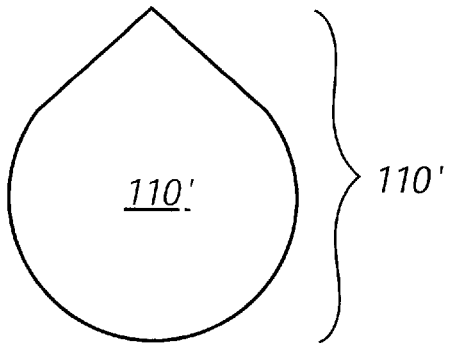
FIG. 2 shows a drill bit tooth which contains two nonparallel axes, and has a "scribe tooth" cross-section in its front portion.

In another class of alternative embodiments, it is contemplated that the tooth can have a non-cylindrical front portion. There are many different non-circular cross-sections which can alternatively be used. FIG. 2 shows a cross section of the front portion 110' of a drill bit tooth which has a "scribe tooth" cross-section in its front portion.

In other alternative embodiments, it is contemplated that the tooth can have a front portion with an elliptical or oval cross section, with the larger axis of this cross-section oriented approximately normal to the axis of the drill string. This embodiment provides a more aggressive cutting action where desired, while still obtaining good support behind the face of the tooth.

Other non-axisymmetric embodiments are also possible. For example, the front part of the tooth may have a diamond cross-section, or may have the shape of a scribe tooth with a rounded tip, or may include transitions from one shape to another.

In other alternative embodiments, it is contemplated that the tooth can have a front portion with an elliptical or oval cross section, with the larger axis of this cross-section oriented approximately parallel to the axis of the drill string. This embodiment provides a less aggressive cutting action where desired, while still obtaining good bonding of the angled tooth to the groove 180 and pocket 170 of the drill bit.

Alternative Embodiment: Matrix Bit

In one type of drag bit, the body itself is made of a cemented carbide material. This is more expensive than a steel body, but the improved abrasion resistance of the cemented carbide body helps to avoid premature abrasion failure of the bit body as tooth failure progresses. Such bits are referred to as "matrix bits." In another class of alternative embodiments, the disclosed inventions can also be applied to such matrix bits.

It is contemplated, as an alternative embodiment, that the angled and front-supported tooth architecture disclosed herein can also be used with such matrix bits. Indeed, with the greater abrasion resistance of such bit bodies, the capacity for field replacement can be particularly advantageous.

The matrix bit body is normally formed by powder-metallurgical methods. In this embodiment it is preferred that the matrix body is formed to include indentations at the pocket locations (which can be ground to final size after sintering). It is also preferred that the body be molded to include a drift hole, parallel to and of smaller diameter than the shank, so that a drift can be used to remove an old tooth once the brazing material has been softened by heat.

Alternative Embodiment with Tapered Shank

Figure 6:
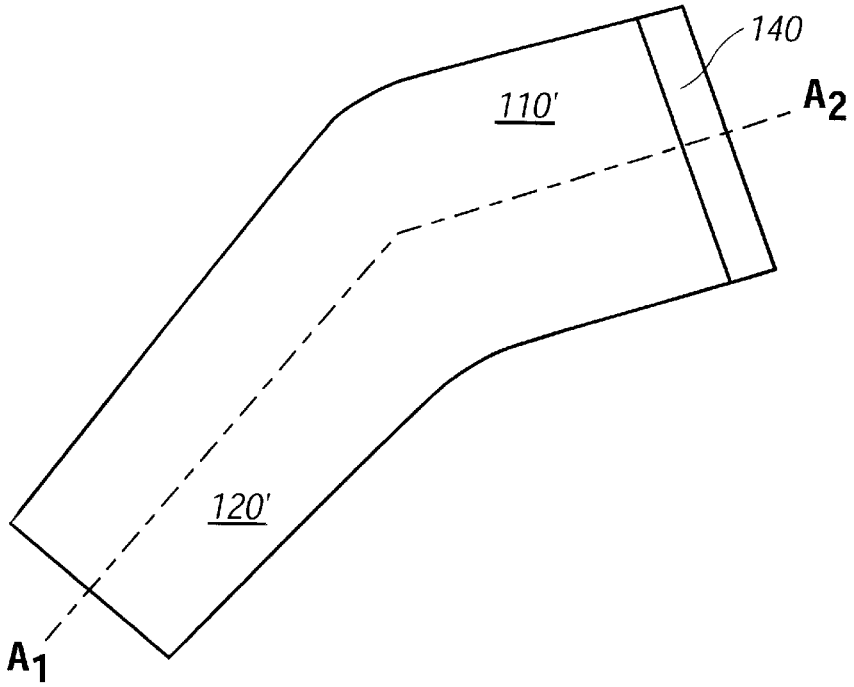
FIG. 6 shows, in an alternative embodiment, a drill bit tooth which contains two nonparallel axes, and also has a tapered shank portion.

FIG. 6 shows, in an alternative embodiment, a drill bit tooth which contains two nonparallel axes $A_1$ and $A_2$, and also has a tapered shank portion 120'. (In this embodiment the axis A1 is defined by the frustroconical shank 120' rather than a cylindrical shank 120.) The tapered shank portion 120' seats into a tapered pocket (not shown). The simple assembly and seating thus defined provides additional reliability, strength, and locational accuracy in seating the tooth into the pocket.

Alternative Embodiment with Non-Spherical End Contour

Figure 7:
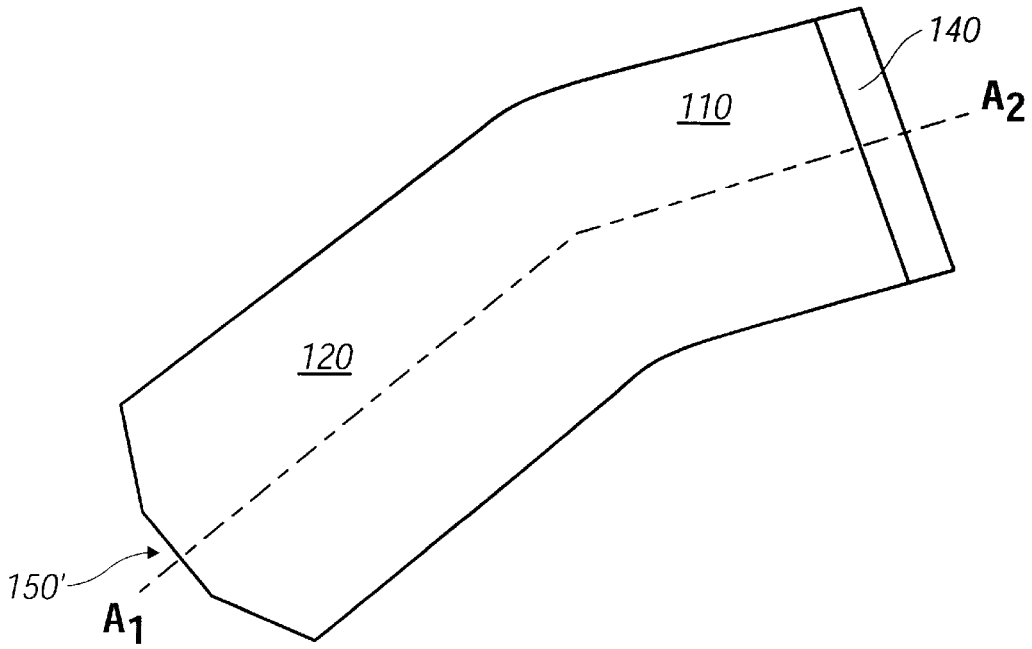
FIG. 7 shows, in an alternative embodiment, a drill bit tooth which contains two nonparallel axes, and whose shank portion ends in a truncated cone.

In this class of embodiments, the contour of end portion 150 is not hemispherical, and does not necessarily define any portion of a spherical surface. As one example of this, FIG. 7 shows a drill bit tooth which contains two nonparallel axes $A_1$ and $A_2$, and whose shank portion 120 ends in a truncated conical (frustro-conical) end 150'. Since the pocket in bits according to the present invention can normally be fabricated by a simple straight-in drilling operation, it is not necessary to use the special spherical cutter shape which is typically used to make hemispherical pockets (by moving the cutter laterally) for use with teeth like those of FIG. 20. In this example the frustro-conical end 150' has a 119° taper, to mate with a drilled pocket.

Alternative Embodiment with Non-Homogenous Composition of Tooth Shank and Front Portion In yet another class of alternative embodiments, it is contemplated that the composition of the tooth shank and front portion of the tooth (apart from the superhard facing portion) can be non-homogenous. By varying the composition of the cemented carbide material within the volume of the shank and/or front portions, the mechanical properties of the tooth can be further optimized.

Different carbides have different tensile strengths and/or different degrees of brittleness. (See, for example, the Cemented Carbides handbook, available from Sandvik Inc., which is hereby incorporated by reference.) By increasing the amount of binder metal (typically cobalt, nickel, or mixtures or alloys thereof), a cemented carbide material can be made more shock-resistant.

Figure 8:
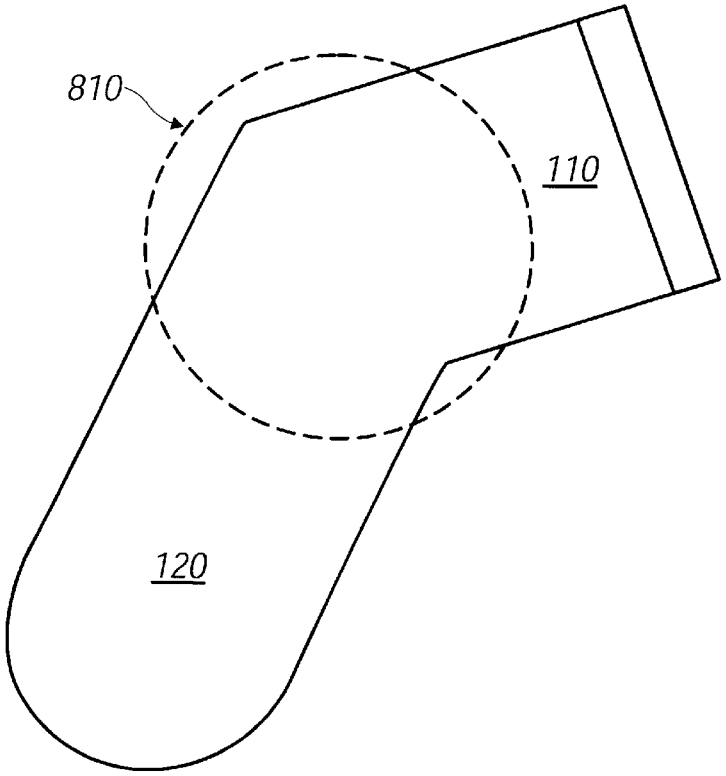
FIG. 8 schematically shows, in an alternative embodiment, a drill bit tooth which has a graded composition, providing different mechanical properties between the portion behind the superhard facing and the end of the shank.

FIG. 8 schematically shows, in an alternative embodiment, a drill bit tooth which has a graded composition, providing different mechanical properties at different locations within the volume of front portion 110 (behind the superhard facing 140) and the shank 120. Preferably the percentage of the binder metal (e.g. cobalt and/or nickel) is increased in the volume 810 near the angle of the tooth, to increase the tensile strength of the material near the inner radius of the bend.

Alternative Embodiment with Non-Planar Tooth Face

Figure 10:
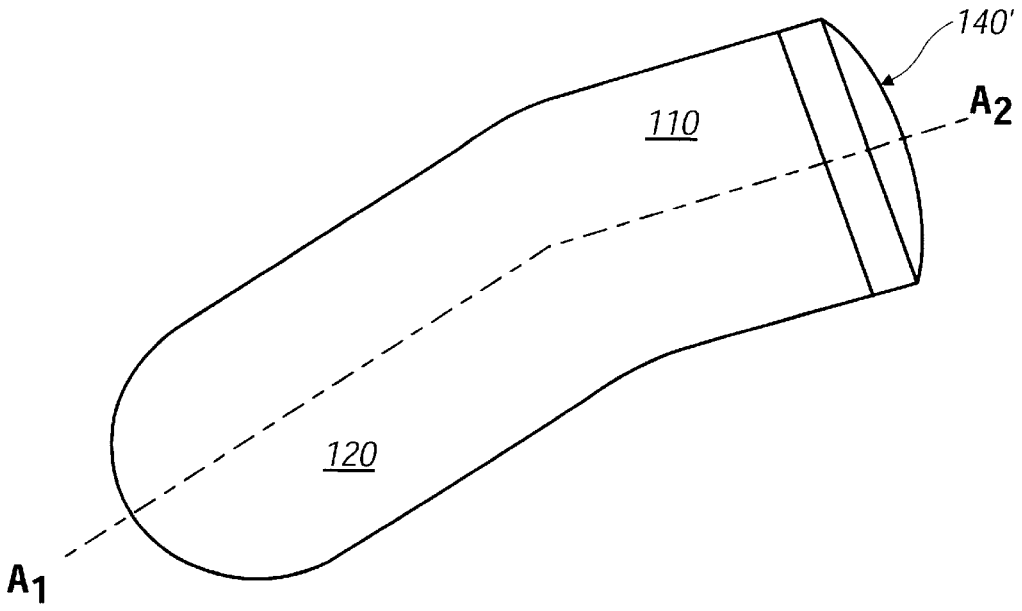
FIG. 10 schematically shows, in an alternative embodiment, a drill bit tooth with a non-planar face.

FIG. 10 schematically shows, in an alternative embodiment, a drill bit tooth with a non-planar face. In this embodiment the outer face of the superhard material 140' is lightly convex, but other shapes can be used instead.

Alternative Embodiment with Radiused Bend

In yet another class of alternative embodiments, it is contemplated that a minimum radius can be imposed at the transition between the axis $A_1$ of the shank 120 and the axis $A_2$ of the front portion 110. As one example of this class of embodiments, FIG. 12 shows a tooth which has a radiused bend 1210 between the shank 120 and the front portion 110. This additional radiusing reduces peak stress in the neighborhood of the bend. In this Figure the points 1212 are each the centroid of a normal cross-section of the tooth, and it may be seen that the locus of these points 1212 forms a gentle curve between axes $A_1$ and $A_2$. FIG. 12 also shows an example of the preferred use of corrugation: preferably some corrugation is present at the interface between the superhard material 140 and the front portion 110, as is conventional, to improve adhesion. (However, this corrugation is not illustrated in most other embodiments.)

Alternative Embodiment: Teeth With and Without Added Superhard Material

In a further alternative class of embodiments, it is contemplated that some or all of the innovative the teeth may have an additional coating of superhard material (PDC or other) on the outer lateral surface of the tooth's front portion. Since this part of the tooth will be exposed to abrasion during use, this additional coating is contemplated as an additional technique for reducing abrasive wear. It is also possible to use such additionally-coated teeth for only some of the teeth, e.g. for those which are positioned to cut at or near the full gage diameter of the bit. Moreover, the field replaceability of the bit is particularly advantageous with this technology, since teeth with additional superhard material volume can be used for field-replacement, when a bit has been pulled up, of particular tooth locations which have shown themselves to be the first to wear out or break. Thus the field-replacement capability provided by various embodiments of the present application is particularly useful for optimizing the balance of the most expensive teeth on a drill bit.

Similarly, teeth in less heavily abraded locations (e.g. toward the bottom central face of the bit) will experience less abrasive wear than most. In one class of embodiments, these less-abraded teeth can optionally be made without the superhard facing 140.

Figure 17:
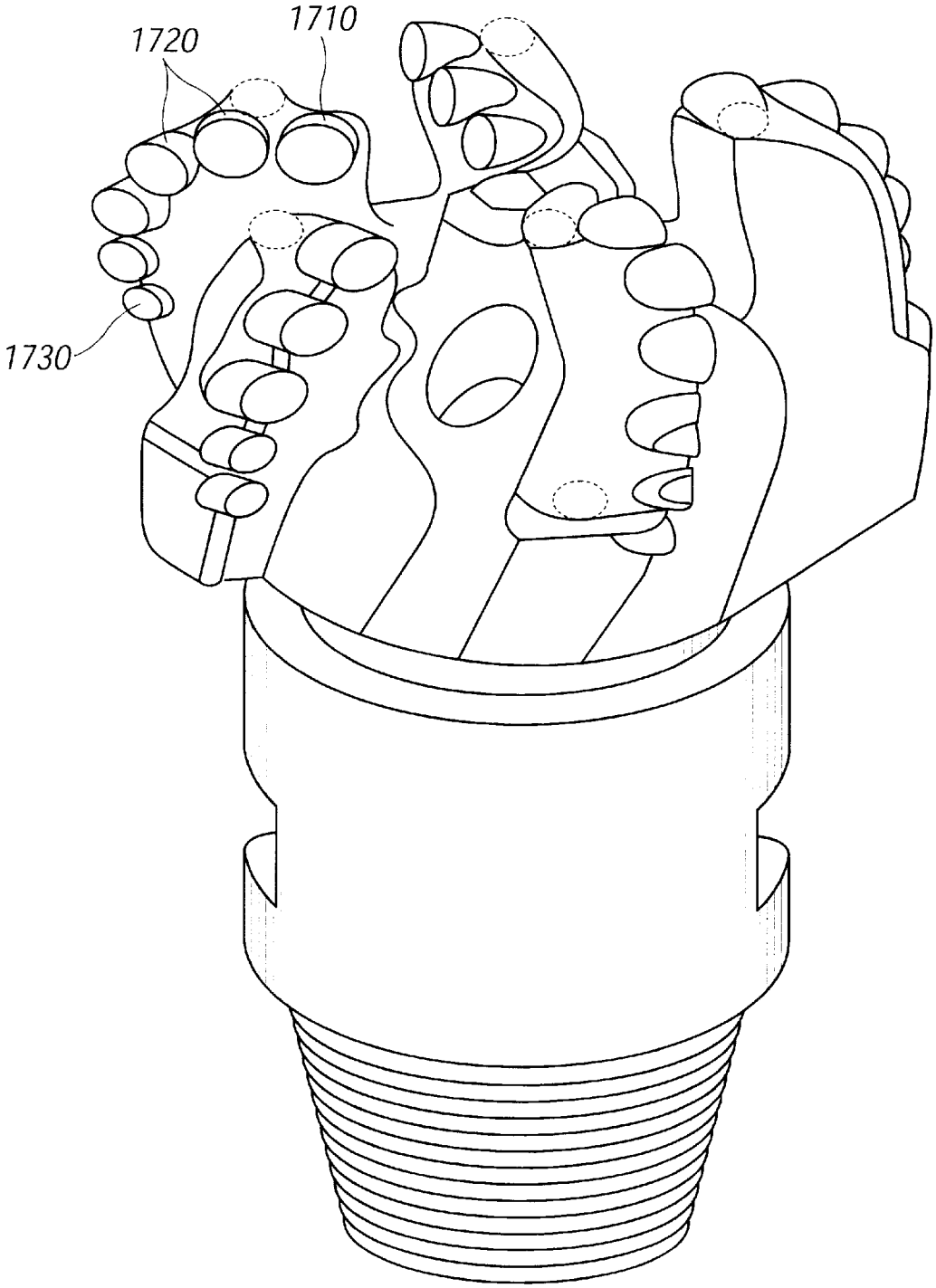
FIG. 17 schematically shows a rotary drill bit which includes both superhard-faced teeth and non-superhard-faced teeth.

FIG. 17 schematically shows a section through a sample embodiment of a drag-type rotary drill bit which includes three kinds of teeth:

the teeth 1710 which are within the central one-third of the bit's radius do not have superhard facing;

all other teeth 1720 and 1730 do have superhard facing; and the teeth 1730 which are at the bit's full gage diameter each include a larger volume of superhard material than do other teeth.

Alternative Embodiment with Face Layers in Addition to or Instead of PDC

Figure 9:
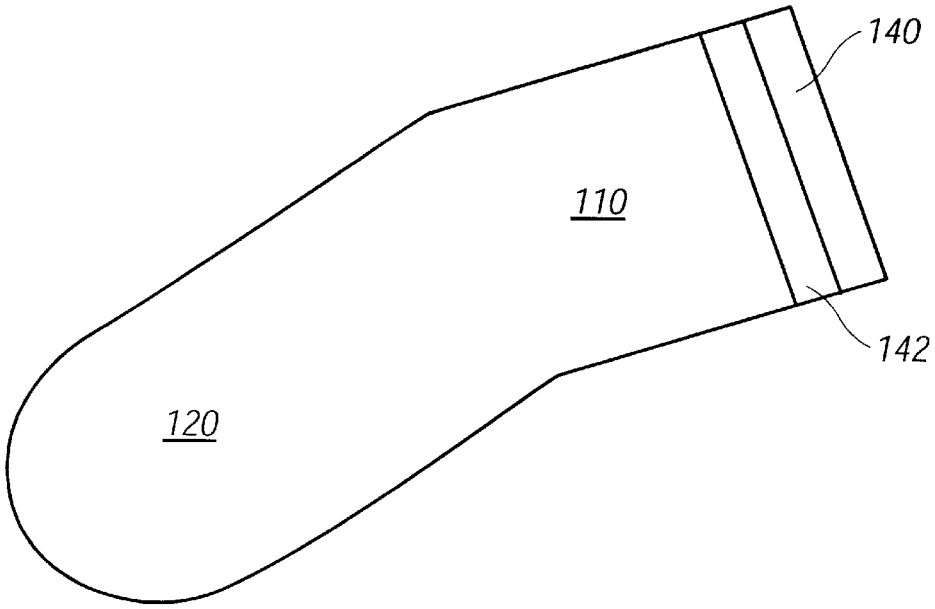
FIG. 9 schematically shows, in an alternative embodiment, a drill bit tooth which includes an additional support layer behind the superhard facing.

The disclosed inventions are not limited to use of only PDC on the primary face contact area. For example, FIG. 9 schematically shows, in an alternative embodiment, a drill bit tooth which includes an additional support layer 142 behind the superhard facing 140. This additional support layer can be, for example, a layer of a PDC which has a lower diamond content than the layer 140 at the cutting face.

In contemplated alternative embodiments, the superhard layer 140 can include other materials instead of or in addition to PDC, including, for example, thermally stabilized polycrystalline diamond ("TSP"), cubic boron nitride, CVD diamond, and/or other superhard combinations of boride, nitride, and diamond compositions.

Alternative Embodiments with Face Not Normal to Axis

Figure 11:
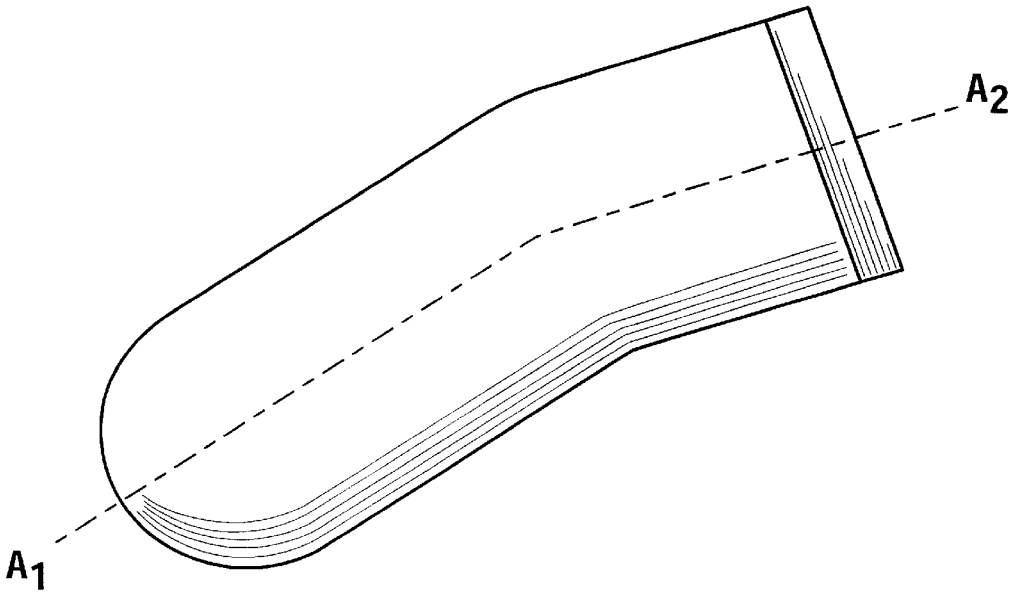
FIG. 11 schematically shows, in an alternative embodiment, a drill bit tooth with a face which is not normal to the axis of the front portion of the tooth.
Figure 13A:
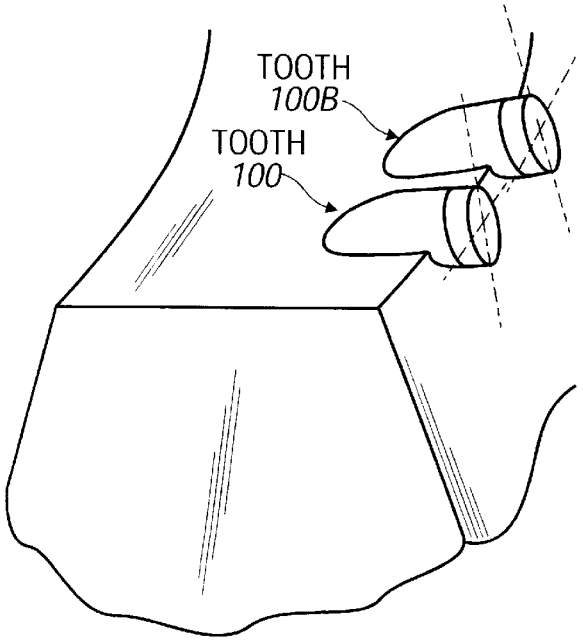
FIG. 13 shows a pair of interchangeable drill bit teeth which have different back rake angles.
Figure 13B:
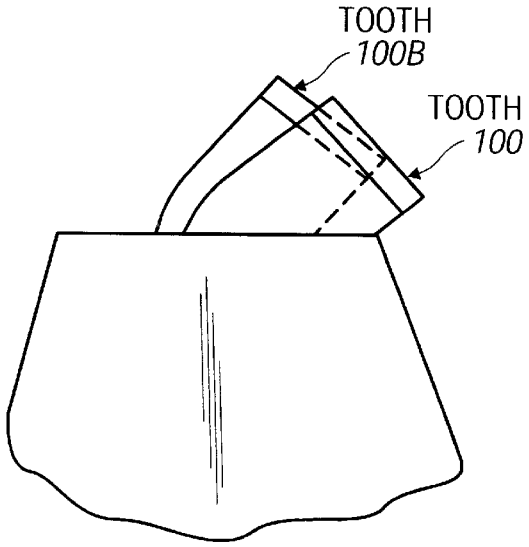
Figure 14A:
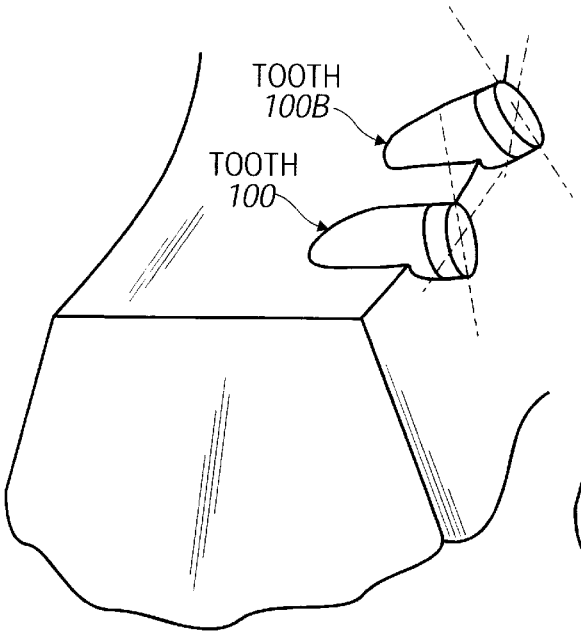
FIG. 14 shows a pair of interchangeable drill bit teeth which have different side rake angles.
Figure 14B:
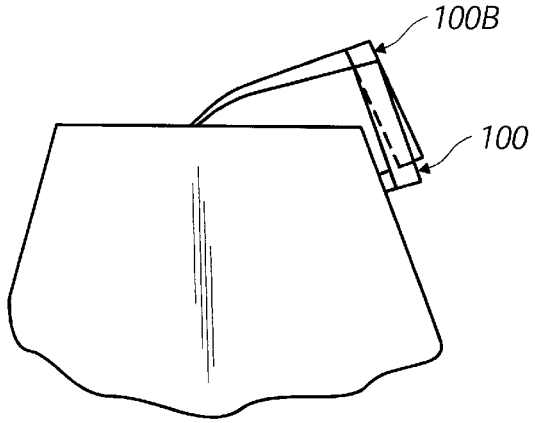

FIG. 11 schematically shows, in an alternative embodiment, a drill bit tooth with a face which is not normal to the axis $A_2$ of the front portion of the tooth. This capability means that the orientation of the front portion of the tooth does not itself define the back and side angles of the actual cutting face. FIGS. 13 and 14 show two of the ways to use this capability.

Alternative Embodiment: Interchangeable Teeth with Different Bend Angles

Figure 3:
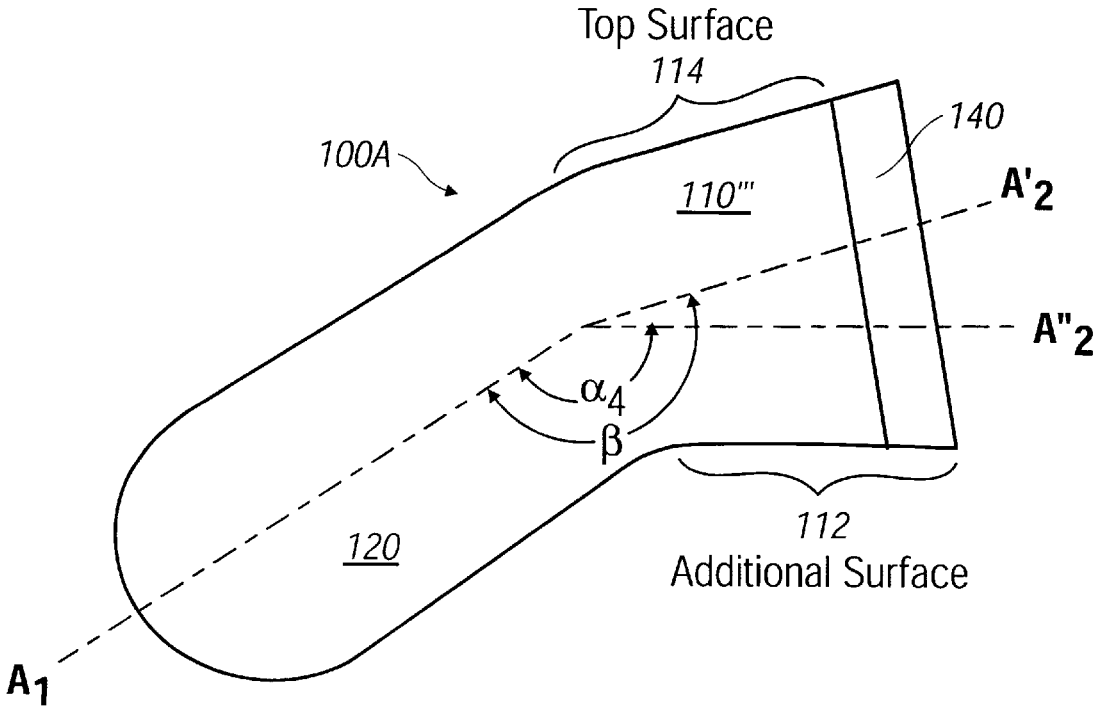
FIG. 3 shows a drill bit tooth which contains two nonparallel axes, and has an additional cylindrical surface for seating to a corresponding recess in the body of the drill bit.

FIG. 3 shows a drill bit tooth which contains two nonparallel axes $A_1$ and $A_2$, and has an additional cylindrical-arc surface 112 for seating to the groove in the body of the drill bit. The angle $\alpha_4$ here is the angle between the axis $A_1$ of the shank and the axis $A_2''$ of the additional surface 112. To achieve a fit, angle $\alpha_4$ must match the angle between the pocket and the groove in the bit body. However, in this class of tooth configurations the front portion 110''' also includes a cylindrical-arc top surface 114 whose axis $A_2'$ is not parallel to the axis $A_2''$ of the additional surface 112. Thus this class of embodiments provides an additional degree of freedom, in that the angle $\beta$ defined by axes $A_1$ and $A_2'$ does not have to be equal to the angle $\alpha_4$ between axes A1 and $A_2''$ (which is constrained by the machining of the bit body itself). Use of this additional variable requires additional manufacturing complexity, but does imply additional capability for field replacement using modified teeth.

FIGS. 1A and 3, in combination, show a pair of interchangeable drill bit teeth which have different nonzero bend angles. Tooth 100, as shown in FIG. 1A, has an angle $\alpha_1$ between a first axis defined by a cylindrical shank (and by the pocket in the bit body) and a second axis defined by the front portion of the tooth (which is parallel to the groove in the bit body). However, in tooth 100A the front portion of the tooth is NOT completely parallel to the groove in the bit body; instead the front portion of the tooth is more nearly parallel to the shank than is the groove. To achieve good bonding under these circumstances, the front portion of the tooth also includes a cylindrical surface which is exactly complementary to the groove in the bit body.

Alternative Embodiment: Interchangeable Teeth with Different Back Rake Angles

FIG. 13 shows a pair of interchangeable drill bit teeth which have different back rake angles. Tooth 100 is the same as in the embodiment of FIG. 1A, but tooth 100B has a different back rake angle. Since the geometry of the shank 120, front portion 110, and end 150 are otherwise exactly the same, the teeth fit into the same groove and pocket geometry, i.e. are interchangeable.

Alternative Embodiment: Interchangeable Teeth with Different Side Rake Angles

FIG. 14 shows a pair of interchangeable drill bit teeth which have different side rake angles. Tooth 100 is the same as in the embodiment of FIG. 1A, but tooth 100C has a different side rake angle. Since the geometry of the shank 120, front portion 110, and end 150 are otherwise exactly the same, the teeth fit into the same groove and pocket geometry, i.e. are interchangeable.

Alternative Embodiment: Interchangeable Teeth with Different Exposures

Figure 15A:
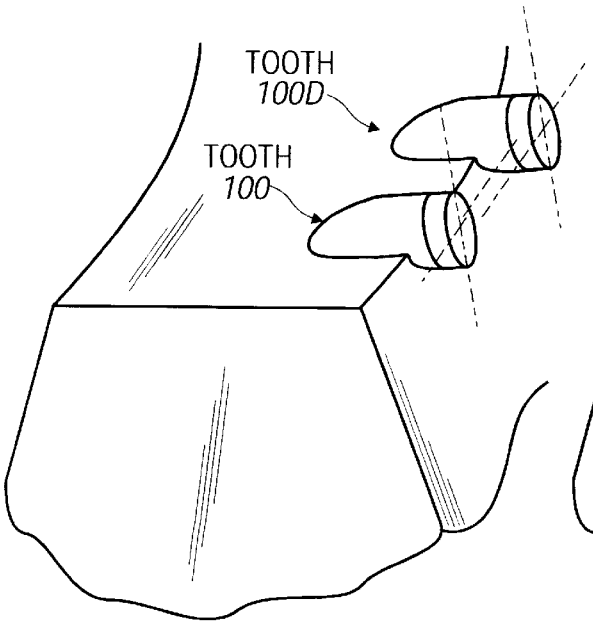
FIG. 15 shows a pair of interchangeable drill bit teeth which have different exposures.
Figure 15B:
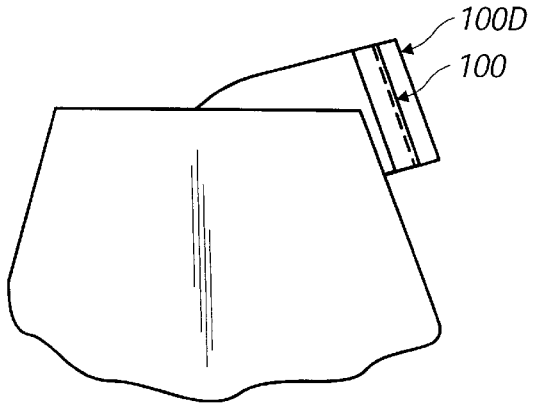

FIG. 15 shows a pair of interchangeable drill bit teeth which have different exposures. Tooth 100 is the same as in the embodiment of FIG. 1A, but tooth 100D has a different side rake angle. Since the geometry of the shank 120, front portion 110, and end 150 are otherwise exactly the same, the teeth fit into the same groove and pocket geometry, i.e. are interchangeable.

Alternative Embodiment: Interchangeable Teeth with Different Cutting Radii

Note that different cutting radii can also be achieved by use of interchangeable teeth. For example, the two interchangeable teeth in the embodiment of FIG. 15 would have slightly different cutting radii, if mounted at the same radius on the bit: the tooth with the longer exposure will have a slightly larger cutting radius. Again, the geometry of the shank 120, front portion 110, and end 150 are otherwise exactly the same, so the teeth fit into the same groove and pocket geometry, i.e. are interchangeable.

These various interchangeable-tooth embodiments permit quick field adjustment of a bit, if needed, for differences in formation hardness or other drilling conditions. Thus increased flexibility in bit optimization is obtained, while also increasing bit lifetime and reducing inventory costs.

Sample Complete Drilling System

Figure 21:
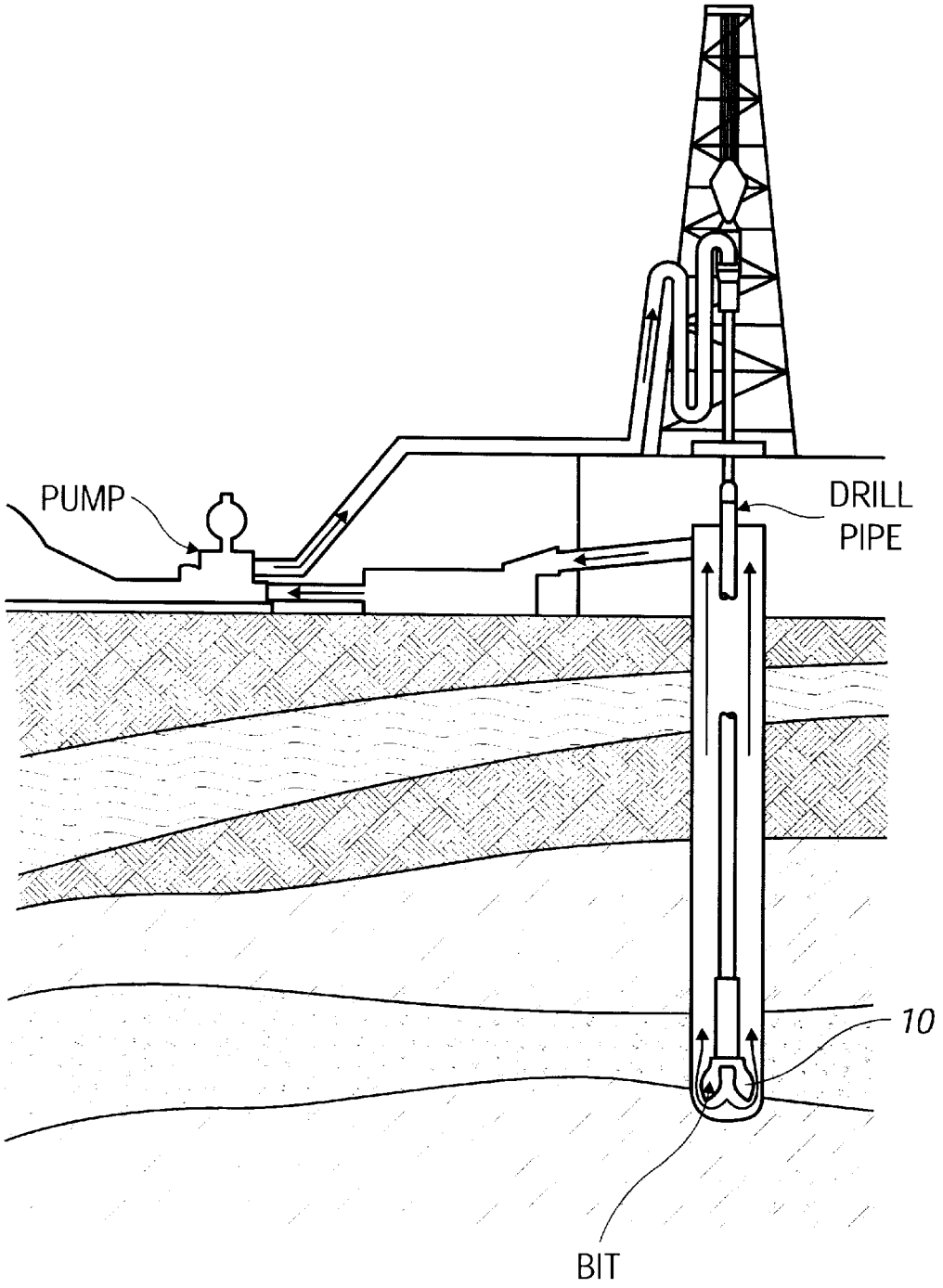
FIG. 21 ( PRIOR ART )
FIG. 21 generally shows a drill rig performing rotary drilling.

FIG. 21 generally shows a drill rig performing rotary drilling. In conventional vertical drilling, a drill bit 10 is mounted on the end of a drill string 12 (drill pipe plus drill collars), which may be several miles long, while at the surface a rotary drive (not shown) turns the drill string, including the bit at the bottom of the hole. A mud pump forces drilling fluid, at high pressures and flow rates, through the drill string.

Alternative Embodiments with Large Bit Diameters

Large-diameter bits (18 inches or greater) are used more often nearer the surface, where tripping is more practical; so the disclosed field-replaceable tooth architecture is particularly attractive for boring shallower stages. Moreover, with larger bits the cost of the whole bit is presumably higher. Moreover, with larger bits the chance of premature failure of one tooth, before the whole set is worn out, is proportionally greater.

In general, the disclosed innovations permit tooth maintenance to be done whenever a bit is available for maintenance work. For example, tooth replacement can be done in a forward location (e.g. on an offshore platform) on a backup bit. For another example, tooth maintenance can be done whenever drilling is paused, e.g. for fishing.

According to a disclosed class of innovative embodiments, there is provided: A drag-type drill bit, comprising: a drill bit body, including at least one tooth pocket and at least one groove; and at least one angled tooth having a shank seated in said pocket and a front portion which is not parallel to said shank and which is bonded to said groove along a length of said front portion which is more than one-half the minimum diameter of said front portion.

According to another disclosed class of innovative embodiments, there is provided: A drag-type drill bit, for rotary drilling within a normal range of weight-on-bit and rotary torque values, comprising: a drill bit body, including at least one tooth pocket, and including a mechanical connection for attachment to a drill string; and a tooth having a shank seated in said pocket and a front portion with a superhard facing thereon; said tooth receiving a respective normal range of average tooth force vectors when the normal range of weight-on-bit and rotary torque values are applied to said mechanical connection; said shank having a primary axis which is oriented at more than about 15 degrees and less than about 45 degrees from said tooth thrust direction, and said front portion having a primary axis which is less than about 15 degrees from said tooth thrust direction, and which is oriented at an angle of more than zero degrees to said primary axis of said shank.

According to another disclosed class of innovative embodiments, there is provided: A family of interchangeable drill bit teeth, each respectively comprising: a shank defining a first axis; and a front portion having a second axis which is at an oblique angle of less than 180 degrees and more than 135 degrees to said first axis; said front portion being faced with a superhard material; wherein at least some different respective ones of said teeth have said superhard material positioned at different respective angles to said first and/or second axes; whereby said different respective ones of said teeth define different angles of back rake and/or side rake.

According to another disclosed class of innovative embodiments, there is provided: A family of interchangeable drill bit teeth, comprising: a plurality of teeth, each comprising a shank which is complementary to a predetermined pocket geometry, and a front portion which is continuous with said shank, and which has an embedding surface which is complementary to a predetermined groove geometry; wherein said predetermined groove geometry is not parallel to said predetermined pocket geometry; and wherein a first one of said teeth is interchangeable, in a given location of a drill bit, with a second one of said teeth which does not have the same cutting geometry as said first one of said tooth, to thereby vary the cutting dynamics of the drill bit.

According to another disclosed class of innovative embodiments, there is provided: A rotary drilling system, comprising: a drill string portion operatively connected to supply drilling fluid to and to apply pressure and torque to a bit; a mud pump connected to pump drilling fluid through said drill string portion to said bit; a rotary mechanism connected to apply torque through said drill string portion to said bit; and a retraction mechanism connected to controllably apply axial pressure through said drill string portion to said bit; wherein said bit is a drag-type drill bit, comprising: a drill bit body, including at least one tooth pocket and at least one groove; and at least one angled tooth having a shank seated in said pocket and a front portion which is not parallel to said shank and which is bonded to said groove along a length of said front portion which is more than one-half the minimum diameter of said front portion.

According to another disclosed class of innovative embodiments, there is provided: a rotary drilling system, comprising: a drill string portion operatively connected to supply drilling fluid to and to apply pressure and torque to a bit; a mud pump connected to pump drilling fluid through said drill string portion to said bit; a rotary mechanism connected to apply torque through said drill string portion to said bit; and a retraction mechanism connected to controllably apply pressure through said drill string portion to said bit; wherein said bit is a drag-type drill bit, for rotary drilling within a normal range of weight-on-bit and rotary torque values, and comprises a drill bit body, including at least one tooth pocket, and including a mechanical connection for attachment to said drill string; and a tooth having a shank seated in said pocket and a front portion with a superhard facing thereon; said tooth receiving a respective normal range of average tooth force vectors when the normal range of weight-on-bit and rotary torque values are applied to said mechanical connection; said shank having a primary axis which is oriented at more than about 15 degrees and less than about 45 degrees from said tooth thrust direction, and said front portion having a primary axis which is less than about 15 degrees from said tooth thrust direction, and which is oriented at an angle of more than zero degrees to said primary axis of said shank.

According to another disclosed class of innovative embodiments, there is provided: a method for rotary drilling, comprising the actions of: pumping drilling fluid through a drill string portion to a rotary drill bit; applying axial force through said drill string portion to said bit; and applying torque through said drill string portion to said bit; wherein said bit is a drag-type drill bit, comprising: a drill bit body, including at least one tooth pocket and at least one groove; and at least one angled tooth having a shank seated in said pocket and a front portion which is not parallel to said shank and which is bonded to said groove along a length of said front portion which is more than one-half the minimum diameter of said front portion.

According to another disclosed class of innovative embodiments, there is provided: a method for rotary drilling, comprising the actions of: pumping drilling fluid through a drill string portion to a rotary drill bit; applying axial force through said drill string portion to said bit; and applying torque through said drill string portion to said bit; wherein said bit is a drag-type drill bit, for rotary drilling within a normal range of weight-on-bit and rotary torque values, and comprises a drill bit body, including at least one tooth pocket, and including a mechanical connection for attachment to said drill string; and a tooth having a shank seated in said pocket and a front portion with a superhard facing thereon; said tooth receiving a respective normal range of average tooth force vectors when the normal range of weight-on-bit and rotary torque values are applied to said mechanical connection; said shank having a primary axis which is oriented at more than about 15 degrees and less than about 45 degrees from said tooth thrust direction, and said front portion having a primary axis which is less than about 15 degrees from said tooth thrust direction, and which is oriented at an angle of more than zero degrees to said primary axis of said shank.

According to another disclosed class of innovative embodiments, there is provided: method for field repair of drag-type drill bits, comprising the actions of: providing at least one angled tooth, having a shank portion which is at an angle to a front portion; providing a bit body having therein at least one socket which is shaped complementary to said shank portion of said tooth, and also having a groove therein which is shaped complementary to said front portion of said tooth; and affixing said shank portion into said socket, while simultaneously affixing said front portion to said groove.

According to another disclosed class of innovative embodiments, there is provided: drill tooth, comprising: a shank defining a first axis, and having a first maximum diameter; and a front portion defining a second axis which is at an oblique angle of less than 180 degrees and more than 135 degrees to said first axis, and which extends away from said first axis for a length which is greater than about twice said first maximum diameter; said shank and said front portion both comprising cemented carbide material; said front portion being faced with a superhard material.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, although the principal system embodiment uses drill pipe with a conventional top drive or rotary drive, tubing and/or downhole motors can alternatively be used. (The higher efficiency of drag bits is particularly attractive in such applications, and hence the present invention makes such applications even more attractive.)

Note that the various interchangeable tooth options can be used in combination with each other, and/or can be applied to a different baseline geometry than that shown in FIG. 1A. In general the illustrated modifications can be used in many different combinations, and many other modifications not shown can also be used, alone or in combination with various illustrated modifications.

The following publications, all of which are hereby incorporated by reference, provide additional detail regarding possible implementations of the disclosed embodiments, and of modifications and variations thereof. Kate Van Dyke, The Bit (4.ed. 1995), together with all other volumes in the Rotary Drilling Series from Petroleum Extension Service; Jim Short, Introduction to Directional and Horizontal Drilling (PennWell 1993); J.-P. Nguyen, Drilling (Technip 1996); Wilson Chin, Wave Propagation in Petroleum Engineering (Gulf 1994); Bourgoyne et al., Applied Drilling Engineering (S.P.E. 1991); and the proceedings volumes of all of the IADC/SPE Drilling Conferences.

The scope of patented subject matter is defined only by the allowed claims. None of these claims are intended to invoke paragraph six of 35 USC section 112 unless the exact words "means for" are followed by a participle.

What is claimed is:

1. A drag-type drill bit, comprising:

a drill bit body, including at least one tooth pocket and a groove, one end of said groove extending to said tooth pocket; and at least one angled tooth having a shank seated in said pocket and a front portion which is not parallel to said shank and which is bonded to said groove along a length of said front portion which is more than one-half the minimum diameter of said front portion.

2. The bit of claim 1, wherein said front portion has a superhard facing thereon.

3. The bit of claim 1, wherein said front portion is generally cylindrical.

4. The bit of claim 1, wherein said shank is generally cylindrical.

5. The bit of claim 1, wherein said front portion is not retained by said groove, other than being bonded thereto.

6. The bit of claim 1, wherein said groove is shaped to sectionally define more than 90 degrees and less than 180 degrees of arc.

7. The bit of claim 1, wherein said drill bit body predominantly comprises steel.

8. A drag-type drill bit, for rotary drilling within a normal range of weight-on-bit and rotary torque values, comprising:

a drill bit body, including at least one tooth pocket, and including a mechanical connection for attachment to a drill string; and a tooth having a shank seated in said pocket and a front portion with a superhard facing thereon;

said tooth receiving a respective normal range of average tooth force vectors when the normal range of weight-on-bit and rotary torque values are applied to said mechanical connection;

said shank having a primary axis which is oriented at more than about 15 degrees and less than about 45 degrees from said tooth thrust direction, and said front portion having a primary axis which is less than about 15 degrees from said tooth thrust direction, and which is oriented at an angle of more than zero degrees to said primary axis of said shank.

9. The bit of claim 8, wherein said front portion of said tooth is bonded into a groove in said drill bit body.

10. The bit of claim 8, wherein said drill bit body predominantly comprises steel.

* * * * *